United States Patent [19]

Lee

[11] Patent Number: 4,848,305

[45] Date of Patent: Jul. 18, 1989

[54] DUAL IGNITION SYSTEM FOR INTERNAL COMBUSTION ENGINES

[76] Inventor: John K. Lee, 11909 Gainsborough Rd., Potomac, Md. 20854

[21] Appl. No.: 182,202

[22] Filed: Apr. 15, 1988

[51] Int. Cl.[4] ..... F02P 7/00

[52] U.S. Cl. ..... 123/637; 123/146.5 A

[58] Field of Search ..... 123/637, 636, 146.5 A, 123/638

[56] References Cited

U.S. PATENT DOCUMENTS

| | | | |
|---|---|---|---|
| 2,412,690 | 12/1946 | Ochsenbein | 123/637 |
| 3,039,021 | 6/1962 | Chertoff et al. | 123/637 |
| 3,165,099 | 1/1965 | Vanderpoel | 123/637 |
| 3,430,617 | 3/1969 | Elberson | 123/637 |
| 3,794,008 | 2/1974 | Mathews | 123/146.5 A |
| 4,194,479 | 3/1980 | Stackaruk | 123/637 |

*Primary Examiner*—Andrew M. Dolinar

*Attorney, Agent, or Firm*—Joseph J. Baker

[57] ABSTRACT

A dual ignition system is disclosed wherein adjacent first and second current interrupter means are provided for each cylinder on the ignition timing means for an internal combustion engine to furnish successive sparks during the power stroke by means of first and second distributor rotor arms which are secured in a fixed angular relationship to each other and which rotate in synchronism with the timing means to thereby more completely ignite the combustibles in said cylinder.

9 Claims, 2 Drawing Sheets

DUAL IGNITION SYSTEM FOR INTERNAL COMBUSTION ENGINES

BACKGROUND OF THE INVENTION

This invention relates to ignition systems for internal combustion engines and more particularly to one capable of providing two successive impulses of current to each spark plug during the power stroke of every four stroke cycle of the engine.

The conventional ignition system in an internal combustion engine is a device for conveying electrical current to the sparking plugs according to the firing order and is well known. Briefly, it comprises the contact-breaker with condenser, the ignition cam, the actual distributor and an automatic timing control device which determines the optimum ignition timing suited to the operating conditions of the engine.

The distributor has a longitudinal shaft whose lower end is connected to a drive pinion in the engine block. This shaft is rotated at the same speed as the camshaft of the engine and carries the ignition cam, which actuates the contact lever rotatably mounted on a plate. Fitted to the upper end of the shaft is the distributor rotor through which an electrode arm passes. The distributor cap is the cover of the housing. At the center, the cap is provided with a carbon brush through which the current is passed to the distributor rotor arm. At the edge of the cap are a number of electrodes, one for each cylinder of the engine. These electrodes are so arranged that the rotor arm is always at a contact just when the contact breaker interrupts the circuit of the primary winding of the ignition coil. At that instant a high voltage is induced in the secondary winding of the ignition coil, and this voltage is allowed to pass through the rotor arm to the appropriate sparking plug. The condenser prevents the occurrence of sparking at the contact breaker. The ignition spark is produced as follows: so long as the contact breaker has not been opened by the cam, current can flow in the primary circuit consisting of the battery, primary winding of the ignition coil, contact breaker and the earth; so that a magnetic field is formed in the ignition coil. At the instant when the contact interrupts the primary circuit, this magnetic field breaks down. This sudden change of the magnetic field induces a high voltage in the secondary winding, which voltage is thereupon applied to one of the sparking plugs, causing it to produce a spark.

The distributor housing also accommodates the timing control which automatically adjusts the optimum ignition timing, which largely depends upon the type of fuel and upon the load and speed of the engine at any particular time (e.g. idling or running under full load).

The aforementioned contact-breaker can be used to control the flow of a control voltage to a transistor or other solid state switching device which in turn controls the current supplied to the ignition coil. In addition, the control voltage to the solid state switching device can be controlled by various other means such as a magnetic pick-up coil sensing a projection or tooth on the distributor shaft in place of the conventional cam lobe, optical triggers employing a light emitting diode sensing slots in a disc carried by the distributor shaft, and various HALL EFFECT-type systems. The principles and teachings of the present invention are adaptable to any of the aforementioned voltage control means.

It is well known that timing control is very important to maximize power and reduce harmful exhaust emissions in the form of unburned hydrocarbon (HC), carbon monoxide (CO) resulting from too rich a fuel mixture or too little oxygen and various oxides of nitrogen (NOX) which when combined with unburned hydrocarbons react with sunlight to form smog. The arrival of current at the spark plug must be a precisely timed event that coincides with the air-fuel mixture being compressed to its maximum by the piston.

In theory, the spark should occur at the plug when the piston is at the very top of its travel in the cylinder also known as the top dead center (TDC) position and the air-fuel mixture is compressed to the maximum. Actually, a particular engine may perform better, either develop more power or lower exhaust emissions, if the spark occurs just slightly before top dead center (BTDC) or slightly after top dead center (ATDC). Normally, each spark plug is caused to fire before its associated piston reaches the top of its stroke which allows sufficient time for the expansion of the gases during combustion to drive the piston back down. However, frequently when the piston reaches the top of the power stroke, the air-fuel mixture flame or combustion is snuffed out prematurely in the combustion chamber. This phenomenon is especially noticed in the late model smaller engines of the two or four cylinders size.

The design of modern internal combustion engines has been changed in an attempt to reduce the aforementioned harmful emissions. For example, compression ratios have been lowered to reduce peak temperatures, combustion chambers have been modified to eliminate areas where combustion can be prematurely extinguished leaving a portion thereof unburned, camshafts have been changed to close exhaust valves early thereby permitting some exhaust gases to mix with the incoming fuel charge, and complex electrical ignition systems have been devised to provide more than the conventional single spark during the power stroke of the engine to name but a few.

Two armed distributor rotors for providing sparking current to various spark plugs at different strokes of the cycle for different cylinders are not new. U.S. Pat. Nos. 1,676,503 and 3,430,617 are examples of such rotors, however, as will be noted, the dual armed rotors do not provide dual ignition sparks for each power stroke of each cylinder as does the present invention.

The use of plural ignition sparks for each power stroke of the cycle for each cylinder is also not new. U.S. Pat. Nos. 3,554,178, 3,926,165 and 4,068,643 all show such a use, however, these devices employ complex costly electronic circuits, which are triggered by a conventional contact-breaker actuated by a single cam lobe for each cylinder or other means such as magnetic pickup systems or the like whereas the present invention teaches the use of two adjacent cam lobes for each cylinder as will be presently explained.

It is therefore the primary object of the present invention to provide a simple yet superior ignition system for internal combustion engines.

It is another object of the invention to provide such a system that is capable of providing two ignition sparks for each power stroke of a four stroke cycle engine.

It is another object of the invention to provide such a system which is adaptable to all present day electronic ignition systems.

It is another object of the invention to provide such a system which is effective, relatively inexpensive and requires no special skill to install or maintain.

It is another object of the invention to provide such a system by which substantial fuel economy can be realized, improved horsepower output and reduced harmful emissions are achieved as a result of the second ignition spark during each power stroke.

Other objects and advantages of my invention will be apparent and obvious from a study of the following description and accompanying drawings which are merely illustrative of the present invention.

Figure 1:
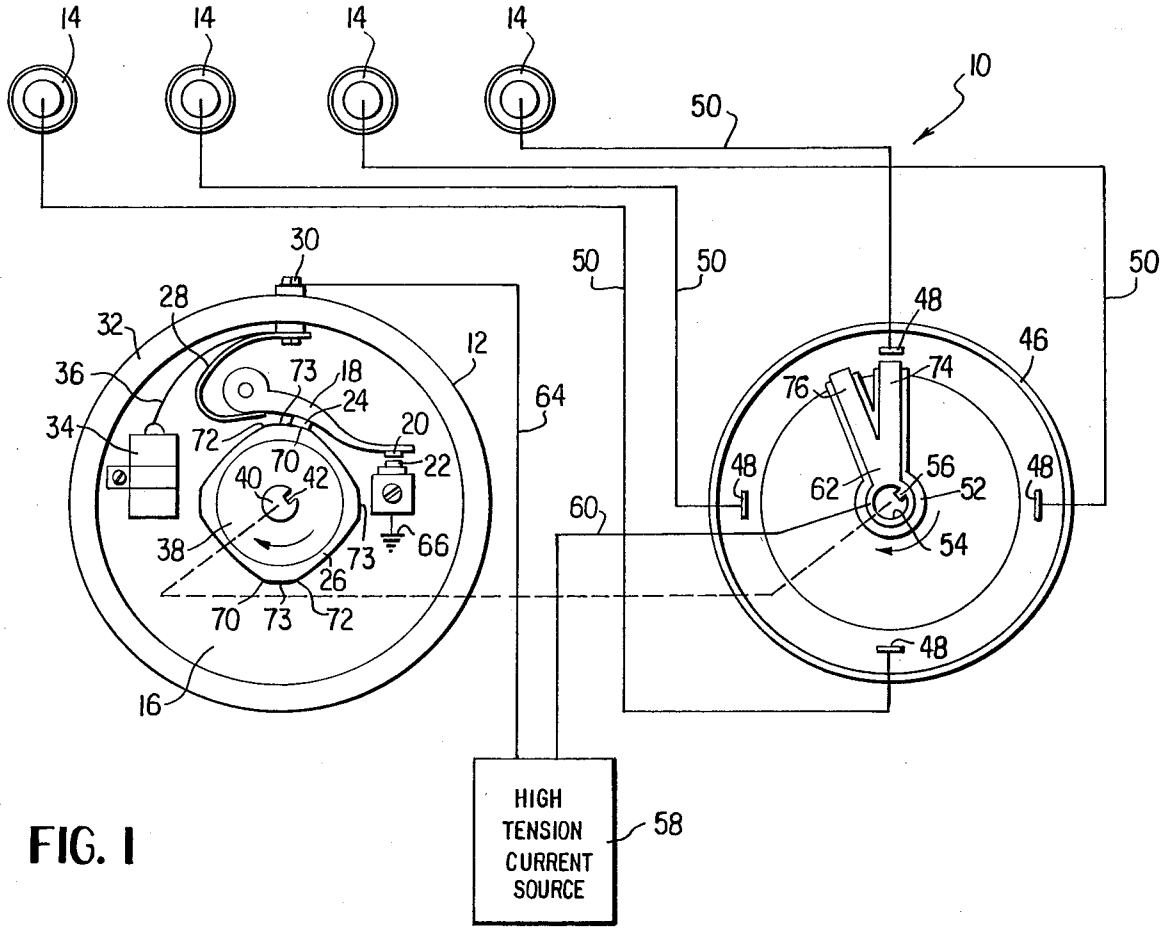
FIG. 1 is a diagrammatic illustration of the ignition system of the present invention for a four cylinder internal combustion engine.

FIGS. *3a*, *3b*, and *3c* are diagrammatic illustrations of additional types of distributors which can be used together with ignition systems employing principles of the present invention.

DETAILED DESCRIPTION OF THE INVENTION

Referring now to the drawings where like characters of reference indicate like elements in each of the several figures, numeral 10 refers generally to a dual ignition system for internal combustion engines.

The dual ignition system 10 comprises a conventional distributor 12 for conveying electrical current to the sparking plugs 14 according to the desired firing order. Four spark plugs 14 one for each of a four cylinder internal combustion are shown for simplicity, it being understood of course that the principles set forth herein are adaptable to engines with any number of cylinders. The distributor 12 has a rotatable base plate 16 on which is pivotably mounted a contact breaker 18 having a first contact point 20. Also mounted on the base plate 16 is a second contact point 22 positioned opposite contact point 20. The contact breaker 18 also has a cam follower 24 which is biased into constant engagement with a rotating cam 26 as will be more fully described later by means of a spring 28. The spring 28 in turn is secured at its free end to terminal 30 on the wall 32 of the distributor 12 to which is also attached a condenser 34 by means of wire 36. The condenser 34 as is well known, prevents occurrence of sparking at contact points 20, 22.

The distributor 12 has a longitudinal shaft whose lower end is connected to a drive pinion in the engine block (not shown) so as to rotate at the same speed as the engine camshaft. The upper end 38 of the longitudinal shaft carries a cam 26 and has a spindle 40 within a notch 42. The distributor 12 also has a cap 46 containing a plurality of electrodes 48 each connected by wires 50 to a respective spark plug 14. A rotor 52 is provided will be more fully described shortly but suffice it to say at this point that the rotor 52 has a recess 54 with a projection 56 which enables it to be mounted on the spindle 40 such that the projection 56 is positioned in the notch 42 to thereby rotate the rotor 52 as the cam 26 rotates.

A source of high tension current such as an ignition coil 58 has its output connected by insulated wire 60 to the rotor electrode 62 and by wire 64 to terminal 30 and it supplies sparking current to the rotor electrode 62 each time the contacts 20, 22 open the circuit to ground 66 by means of the cam 26 in a well known manner. This sparking current is delivered to the respective spark plugs as the rotor arm 62 is rotated to a position opposite the electrodes 48 to which the spark plugs are connected. In a conventional ignition system where the cam has one lobe for each cylinder and a single rotor contact arm, each opening of the breaker contacts would cause a single spark at the spark plug during the power stroke in each cylinder of a four stroke cycle engine. Because there is only one ignition of the fuel-air mixture during each power stroke, unburned fuel remains in the combustion chamber thereby contributing to pollution and a reduction in engine efficiency.

Applicant, in an effort to more completely burn the fuel charge in each cylinder during its power stroke, provides the cam 26 with two lobes 70, 72 for each cylinder of the engine and the rotor electrode 62 with two corresponding contact arms 74,76. The cam 26 has a relatively flat cam face 73 between the lobes 70, 72. The angular relationship of the lobes 70, 72 to each other is the same as the angular relationship of the contact arms 74, 76 to each other relative to the center of the upper cam shaft end 38 and recess 54 as will be more fully described with regard to FIG. 2. The cam lobes 70, 72 open contact points 20, 22 twice during each power stroke of each cylinder during each four stroke cycle with a corresponding spark at the spark plug 14 as directed by the rotating contact arms 74, 76 rotating in synchronism with the cam 26. For example, as FIG. 1 illustrates, as cam lobe 70 is engaged by cam follower 24 to thereby open contact points 20, 22, high tension current source 58 provides a sparking current to the rotor electrode 62 via wire 60. Simultaneously, the contact arm 74 will be aligned opposite an electrode 48 to permit the sparking current to be transferred thereto and to a particular spark plug 14 via wire 50 depending on the firing order for the particular engine. Similarly, as cam lobe 72 is rotated to open contact breakers 20, 22, contact arm 76 will align with the same electrode 48 to thereby deliver a second sparking current to the same spark plug 14 for the same power stroke.

Figure 2:
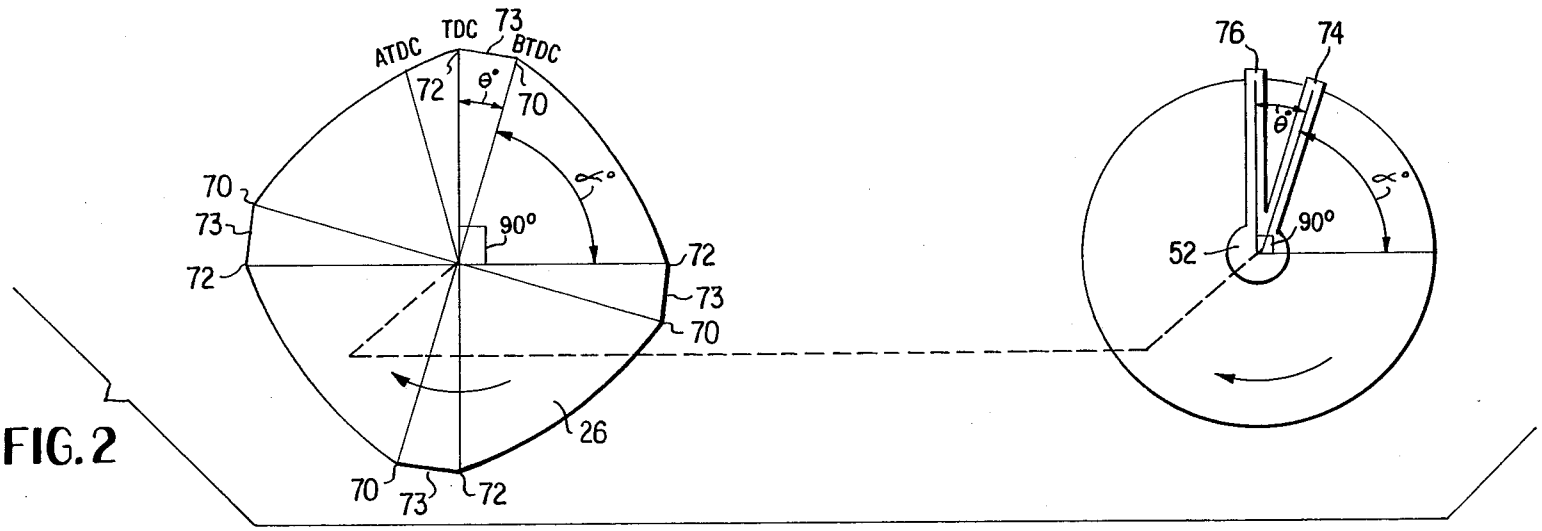
FIG. 2 is a diagrammatic illustration of the ignition contact breaker cam and distributor rotor of the present invention.

Referring now to FIG. 2, cam lobe 72, for example, is fixed to rotate relative to the engines camshaft to bring it adjacent cam follower 24 at the point that the piston reaches its top-dead-center (TDC) position or the beginning of the power stroke. Typically cam lobe 70 is shown positioned on the cam 26 $\theta$ radial degrees to the right or ahead of cam lobe 72 as the cam 26 is rotated in the clockwise direction. Cam lobe 72 is thus located $\theta$ radial degrees before top dead center (BTDC) in this example. Because the rotor 52 is fixed to and rotates with cam 26, contact arm 74 must be also positioned the same $\theta$ radial degrees to the right of contact arm 76 as numbered in FIG. 2 to ensure proper delivery of the sparking current. Actually, as aforementioned, a particular engine may perform better, either develop more power or lower exhaust emissions if the spark occurs just slightly before top dead center (BTDC) slightly after top-dead-center (ATDC). However, more typically the spark is delivered before the piston reaches the top of its power stroke or BTDC which permits sufficient time for expansion of the gasses during combustion. However, because this combustion is often snuffed out prematurely, particularly in smaller engines, applicant's second spark arriving at the top dead center (TDC) position of the piston results in more complete combustion of the fuel/air charge with corresponding reductions in the aforecited emissions and a noticeable increase in output power. Typically $\theta$ is about 15 radial degrees and usually falls within a range of between 10° and 20°. The angle $\alpha$ is then 90° radial degrees substantially less than 180° minus $\theta$.

Figure 3C:
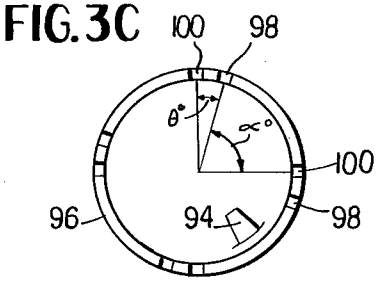
Figure 3B:
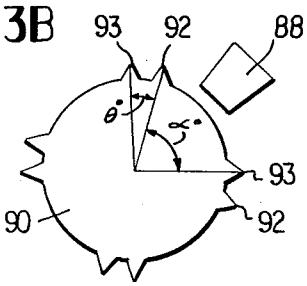
Figure 3A:
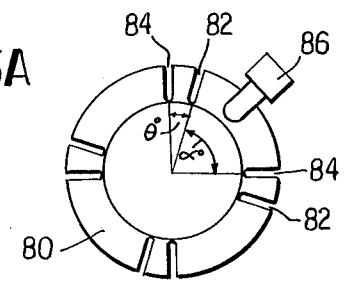

FIGS. 3A, 3B and 3C illustrate additional types of devices for triggering, by means of transistorized circuits, the high tension current source 58 which could be used in place of contact breaker 18, cam 26, contact points 20, 22 and condenser 34. The construction of rotor 52 would, however, remain the same.

FIG. 3A discloses a disc 80 which would typically be rotated in synchronism with the engine camshaft. The disc would have a pair of slots 82, 84 for each cylinder which would permit light from a source (not shown) to reach a light sensitive diode 86 as each slit passes to thereby trigger the high tension current source 59. The slits would be positioned at $\theta$ radial degrees apart with the rotor contact arms 74, 76 being positioned at the same $\theta$ degrees.

FIG. 3B shows the use of a magnetic pickup coil 88 positioned adjacent a cylindrically-shaped rotatable member 90 having a plurality of longitudinally extending teeth or sensor rods 92, 93. The teeth would be positioned at $\theta$ radial degrees apart with the rotor contact arms 74, 76 separated an equal number of degrees. The magnetic field in the pickup coil 88 would sense the presence of the tooth or sensor rod 92, 93 and trigger a sparking current from the high tension current source 58.

FIG. 3C discloses an ignition system using a HALL EFFECT device 94 positioned adjacent a rotatable cylindrical member 96 having rectangular-shaped plate sections 98, 100 formed longitudinally therein. A voltage shift is generated when one of the rectangular plates carrying an electric current is passed through a magnetic field that is perpendicular to the current flow. This voltage shift is sensed to trigger a sparking current from the high tension current source 58. The rectangular current carrying plates 98, 100 would be positioned at $\theta$ radial degrees apart with the rotor contact arms 74, 76 separated an equal number of degrees.

As will be apparent to those familiar with the art, the invention may be embodied in other specific forms without departing from the spirit or essential characteristics thereof. The embodiments disclosed thereof are to be considered in all respects as illustrative, rather than restrictive, the scope of the invention being indicated by the appended claims.

I claim:

1. In an internal combustion engine having a plurality of cylinders and reciprocating pistons therein arranged to sequentially have successive intake, compression, power and exhaust strokes; ignition means including a high tension current source, timing means having a first current control means for momentarily controlling current flow in the high tension source, and distributor means having a first distributor arm rotating synchronously with the reciprocation of the pistons and connected to said high tension current source and adapted to momentarily communicate a first spark to a spark plug in each cylinder just prior to the commencement of its power stroke; the improvement comprising a second current control means for each cylinder adjacent said first current control means for momentarily controlling said current in said high tension source a second time, and said distributor means having a second rotating distributor arm electrically connected to said first distributor arm for successively momentarily communicating a second spark to said spark plug in each cylinder at the commencement of said power stroke to more completely ignite combustibles in said cylinders.

2. An internal combustion engine as set forth in claim 1, wherein said first and second distributor arms are secured in a fixed angular relationship to each other.

3. An internal combustion engine as set forth in claim 2, wherein said first and second current control means are in the same angular degree relationship to each other as is the angular degree relationship of said first and second distributor arms to each other.

4. An internal combustion engine as set forth in claim 3, wherein said first and second current control means comprises respective first and second lobes on a cam rotating in synchronization with said first and second distributor arms and a set of electrical contacts operative to open upon engagement with said first and second cam lobes.

5. A multiple spark ignition system for igniting the fuel charge in the power stroke of an internal combustion engine comprising in combination:

an ignition means including a high tension current source;

timing means having a first and second current control means for momentarily controlling current in said high tension current source to produce respective first and second sparks at a spark plug; and distributor means connected to said high tension source, said distributor means having right first and second radially extending distributor arms rotating in synchronism with said timing means to deliver said first and second sparks respectively at said spark plug to ignite said fuel charge during each power stroke of said internal combustion engine.

6. The system as set forth in claim 5, wherein said first and second distributor arms are secured in fixed angular relationship to each other.

7. The system as set forth in claim 6, wherein said first and second current control means are in the same angular degree relationship to each other as is the angular degree relationship of said first and second distributor arms to each other.

8. In an internal combustion engine having a plurality of cylinders and reciprocating pistons therein arranged to sequentially have successive intake, compression, power and exhaust strokes; ignition means including a high tension current source, timing means having a first current control means for momentarily controlling current flow in the high tension source, and distributor means having a first distributor arm rotating synchronously with the reciprocation of the pistons and connected to said high tension current source and adapted to momentarily communicate a first spark to each cylinder just prior to the commencement of its power stroke; the improvement comprising a second current control means for each cylinder adjacent said first current control means for momentarily controlling said current in said high tension source a second time, and said distributor means having a second rotating distributor arm electrically connected to said first distributor arm for successively momentarily communicating a second spark to each cylinder at the commencement of said power stroke to more completely ignite combustibles in said cylinders, said first and second distributor arms being secured in a fixed angular relationship to each other substantially less than 180 degrees.

9. A multiple spark ignition system for igniting the fuel charge in the power stroke of a internal combustion engine comprising in combination:

an ignition means including a high tension current source;

timing means having a first and second current control means for momentarily controlling current in said high tension current source to produce respective first and second sparks; and distributor means connected to said high tension source, said distributor means having first and second radially extending distributor arms rotating in synchronism with said timing means to deliver said first and second sparks respectively to said fuel charge during each power stroke of said internal combustion engine, said first and second distributor means being secured in a fixed angular relationship to each other substantially less than 180 degrees.

* * * * *